US007234591B2

(12) United States Patent
Le Bras et al.

(10) Patent No.: US 7,234,591 B2
(45) Date of Patent: Jun. 26, 2007

(54) CARTON WITH OVERLAPPED BASE PANELS AND BLANK THEREFOR

(75) Inventors: Philippe Le Bras, Chateauroux (FR); Philippe Marie, Coings (FR)

(73) Assignee: MeadWestvaco Packaging Systems, LLC, Glen Allen, VA (US)

( * ) Notice: Subject to any disclaimer, the term of this patent is extended or adjusted under 35 U.S.C. 154(b) by 0 days.

(21) Appl. No.: 10/912,805

(22) Filed: Aug. 6, 2004

(65) Prior Publication Data

US 2005/0035010 A1 Feb. 17, 2005

Related U.S. Application Data

(63) Continuation of application No. PCT/US03/03540, filed on Feb. 7, 2003.

(51) Int. Cl.
*B65D 75/00* (2006.01)

(52) U.S. Cl. ..... 206/140; 206/434

(58) Field of Classification Search ..... 206/140, 206/193, 197, 427, 434; 229/103.5, 185, 229/103.2

See application file for complete search history.

(56) References Cited

U.S. PATENT DOCUMENTS

| | | | |
|---|---|---|---|
| 2,190,433 | A | 2/1940 | Palmer |
| 3,233,483 | A | 2/1966 | Wood |
| 3,330,463 | A | 7/1967 | Wood |
| 3,374,938 | A | 3/1968 | Pierce, Jr. |
| 3,380,645 | A | 4/1968 | Pierce, Jr. |
| 3,493,261 | A | 2/1970 | Funkhouser et al. |
| 3,517,876 | A | 6/1970 | Stout |
| 3,894,681 | A | 7/1975 | Arneson et al. |
| 4,077,095 | A | 3/1978 | Oliff |
| 4,234,143 | A | 11/1980 | Pesando |
| 4,328,893 | A | 5/1982 | Oliff et al. |
| 4,337,888 | A | 7/1982 | Kudalkar |
| 4,382,506 | A | 5/1983 | Chaussadas |
| 5,180,054 | A | 1/1993 | Bakx |
| 5,588,586 | A | 12/1996 | Negelen |

FOREIGN PATENT DOCUMENTS

| | | |
|---|---|---|
| EP | 0662916 B1 | 10/1993 |
| FR | 77 21732 | 3/1978 |
| FR | 79 06593 | 10/1979 |
| GB | 1 327 840 A | 8/1973 |
| GB | 1 493 811 A | 11/1977 |
| GB | 2 294 254 A | 4/1996 |
| WO | WO 88/02607 A1 | 4/1988 |
| WO | WO 94/07759 A1 | 4/1994 |

*Primary Examiner*—David T. Fidei
(74) *Attorney, Agent, or Firm*—Tsugihiko Suzuki

(57) ABSTRACT

A carton of the wrap-around type has a pair of overlapped base panels. One of the base panels which carries a locking tab overlies a tongue protruding from the end edge of the other base panel. The protruding tongue is formed with a complementary locking aperture engaged by the locking tab to secure the overlapped panels together. On either side of the locking tab, the said one base panel has a hinged tab protruding from the end edge of that panel. Each of the hinged tabs underlies the end edge of the other base panel, one on each side of the protruding tongue. This 'over and under' arrangement presents less of an externally overlapped edge than is the case of a simple complete overlap and thus mitigates against the base panels being skewed or prized apart leading to tearing and/or dislodgement of the locking means.

9 Claims, 4 Drawing Sheets

CARTON WITH OVERLAPPED BASE PANELS AND BLANK THEREFOR

This is a continuation of international application No. PCT/US03/03540, filed Feb. 7, 2003, which is hereby incorporated by reference.

BACKGROUND OF THE INVENTION

This invention relates to a carton with overlapped base panels and to a blank for forming the carton. More specifically, the invention relates to a wrap-around carton in which the base panels are overlapped and secured together by a single punch lock. Punch locks are well known and comprise a locking tab formed in one of the base panels which is driven through and secured in locking engagement with a receiving aperture defined by hinged tab in the other base panel.

It has been found that in cartons which have a single central punch lock which secure the base panels together two problems are experienced. One problem relates to the vulnerability of the lock to tearing, which sometimes occurs when the base panels are prized out of face contacting relationship with one another, for example, when the carton is stacked on a supermarket shelf, which has a tendency to put a tearing stress on the lock. Another problem encountered is that the base panels tend to pivot or skew relative to one another about the lock which also can cause tearing of the lock, or disengagement of the lock, which then destroys the integrity of the carton so that for packaging and marketing purposes it is completely useless.

The present invention seeks to provide a carton having a base panel arrangement so that the panels are not overlapped in the conventional way, i.e. where one panel end edge completely overlaps the other panel end edge, but rather are overlapped in an 'over and under' arrangement.

A known carton and blank of the wrap-around type is disclosed in GB 1 493 811 which includes shaped base panels in which one of the base panels includes a series of three punched locks all disposed along a tongue of the panel and the complementary locking apertures are formed in the opposite base panel adjacent an end edge which is recessed from the rest of that panel.

There is no disclosure of the panels being overlapped in other than the conventional manner and, indeed, if the 'over and under' overlapping arrangement envisaged by the present invention were to be adopted then the punch locks could not be brought into register with the complementary locking apertures so that the base panels of the carton could not be locked together.

SUMMARY OF THE INVENTION

The present invention seeks to overcome or at least mitigate the problems of the prior art.

One aspect of the present invention provides a carton comprising first and second overlapping panels provided respectively with mutually engaged male and female punch-lock arrangement and alignment means for facilitating alignment of the locking tabs during the panel interlocking process. The alignment means comprises a tongue protruding from an end edge of the first panel and a pair of flaps hinged in a spaced arrangement to an end edge of the second panel. Each of the hinged flaps underlies the end edge of the first panel, one on each side of the protruding tongue.

Preferably, the second panel is disposed over the tongue while the hinged flaps are disposed under the first panel in engagement with the opposed side edges of the tongue.

According to an optional feature of this aspect of the present invention, the protruding tongue includes a locking aperture which is engaged by a locking tab disposed adjacent the end edge of the second panel to secure the overlapping first and second panels together. Preferably, the aperture is defined by said female locking tab.

A second aspect of the present invention provides a carton for accommodating at least one article which carton includes a pair of overlapping base panels which are secured together along a part or parts only over the overlap so that an exposed edge of an unsecured panel is exposed externally of the carton. An end edge part of one base panel is overlapped externally of the carton, relative to an end edge part of the other base panel, and an adjacent end edge part of the other base panel is overlapped externally of the carton relative to another end edge part of the one base panel.

Preferably, the end edge part of the one base panel is secured to the end edge part of the other base panel, whereas the adjacent end edge part of the other base panel is left unsecured to the one base panel.

In some embodiments, the end edge part of the one base panel is a part of that panel intermediate the opposite extremities of its end edge and wherein the adjacent end edge part of the other base panel comprises a pair of spaced end edge parts flanking, one of each of the intermediate edge part.

The intermediate edge part of the one panel may overlap a protruding tongue disposed intermediate the pair of spaced end edge portions.

Preferably, the intermediate edge part of the one panel is a recessed edge part of the end edge of that panel and is flanked by spaced protruding tabs.

Alternatively, the end edge parts flanking the protruding tongue may overlap respective ones of the protruding tabs.

According to an optional feature of the second aspect of the present invention, the protruding tabs are hinged to the adjacent parts of the one base panel.

According to a further optional feature of this aspect of the present invention, the intermediate end edge part of the one base panel and the adjacent end edge parts of the other base panel are substantially aligned.

A second aspect of the present invention provides a blank comprising first and second overlapping panels provided respectively with mutually engaged male and female punch-lock arrangement and alignment means for facilitating alignment of the locking tabs during the panel interlocking process, the alignment means comprising a tongue protruding from an end edge of the first panel and a pair of flaps hinged in a spaced arrangement to an end edge of the second panel and wherein each of the hinged flaps underlies the end edge of the first panel, one on each side of the protruding tongue.

Preferably, the protruding tongue includes a locking aperture which is engaged by a locking tab disposed adjacent the end edge of the second panel to secure the overlapping first and second panels together.

Preferably, the aperture is defined by said female locking tab

BRIEF DESCRIPTION OF THE DRAWINGS

Exemplary embodiments of the invention will now be described by way of example only, with reference to the accompanying drawings, in which:—

DETAILED DESCRIPTION OF THE PREFERRED EMBODIMENT

Figure 1:
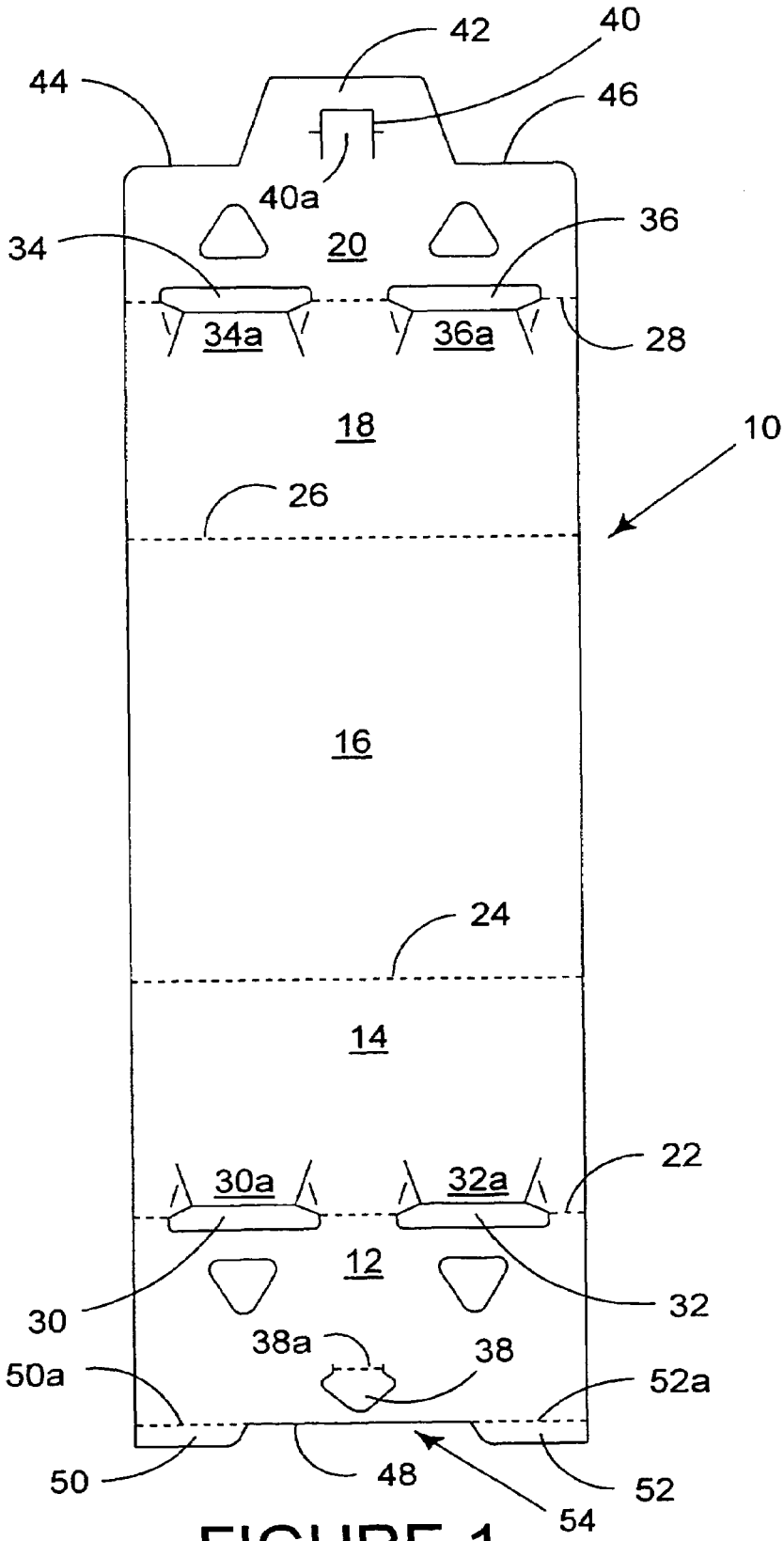
FIG. 1 is a plan view of a blank for forming a wrap-around carton according to one embodiment of the invention.
Figure 2:
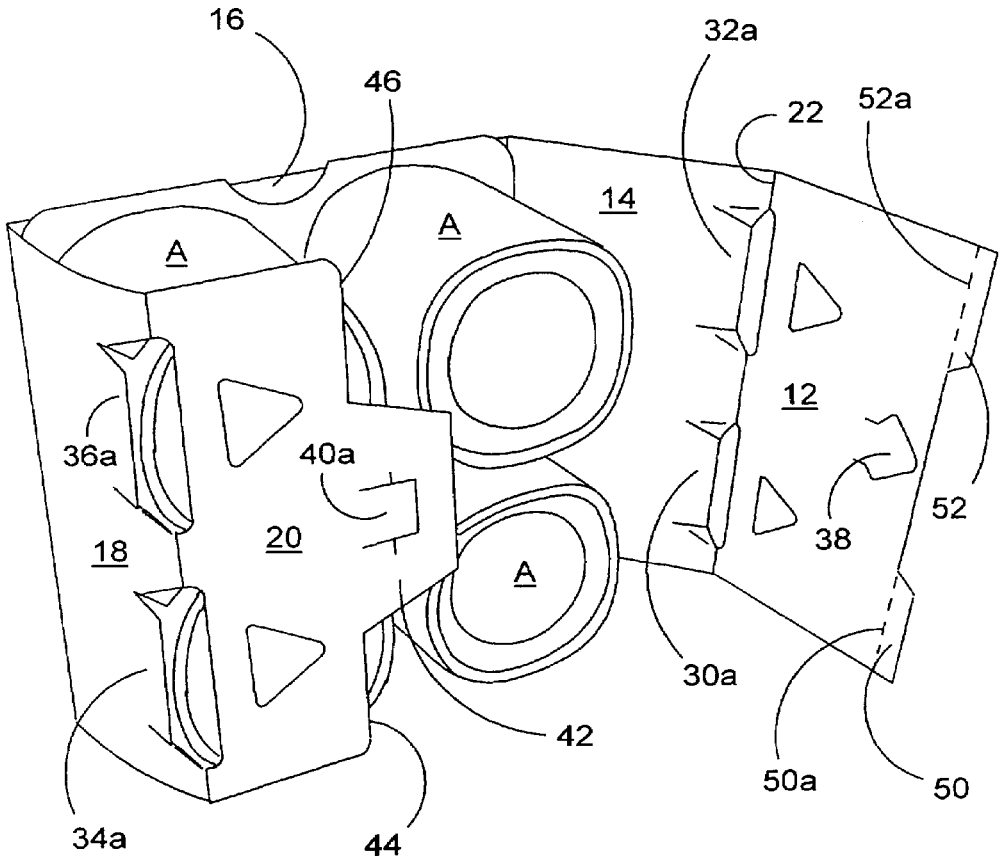
FIG. 2 is a perspective view of the blank partially applied to a group of four containers, which in this embodiment are pots containing dairy produce.

Referring to the drawings and, in particular, FIG. 1, there is shown a blank 10 formed from paperboard or sheet material having a similar function. In this embodiment, the blank is of the well-known wrap-around type to be wrapped around a set of containers, for example a group of pots 'P' (FIG. 2). The elongate blank 10 comprises in series a first base panel 12, a first side wall panel 14, a top panel 16, second side wall panel 18, and a second base panel 20 hinged one to the next along successive transverse fold lines 22, 24, 26 and 28 respectively.

In one class of embodiments, in order to prevent end-wise movement of the articles when they are received in the sleeve formed from the blank, heel retention apertures 30, 32 are formed partially in the first base panel 12 and partially in the side wall panel 14 along the transverse fold line 22. The heel retention openings are enhanced by hinged flaps 30*a*, 32*a* respectively. Similar heel retention apertures 34, 36 are formed partially within second base panel 20 and partially within side wall 18 along transverse fold line 28. These heel retention openings also are enhanced by hinged flaps 34*a*, 36*a* respectively.

First base panel 12 is formed with a "male" locking tab 38 of the punch-lock type. These locks are well known in the art and the locking tab is adapted to be hinged about its base hinge line 38*a* out of the plane of the blank and received in a locking aperture 40 defined, in this embodiment, by a hinged tab 40*a* ("female" tab) formed in the second base panel 20 when the locking tab is brought into registry with the locking aperture.

Normally in prior art arrangements, the base panels are simply overlapped by bringing the panel having the locking tab, externally of the carton, into overlapping relationship with the panel having the locking aperture. However, in the present invention, the panels are overlapped in an "over and under" arrangement. To this end, the extreme end edge of second base panel 20 is formed with a protruding tongue 42 which protrudes beyond the adjacent parts 44, 46 of the remainder of the end edge of base panel 20. Preferably, the locking aperture 40 is formed within the protruding tongue 42. At the opposite end of the blank the first base panel 12 is formed with a central end edge 48 which is flanked by a pair of hinged flaps 50, 52 having hinge lines 50*a*, 52*a* respectively to define a recess.

In order to form the completed carrier in flat collapsed condition from the blank, a series of sequential folding operations are required and will be described further with reference to FIGS. 2 to 6 of the drawings. The folding operations can be performed in one or more straight line machines, so that the carton is not required to be rotated or inverted to complete its construction. The folding process is not limited to that described below and can be altered according to particular manufacturing requirements.

Figure 3:
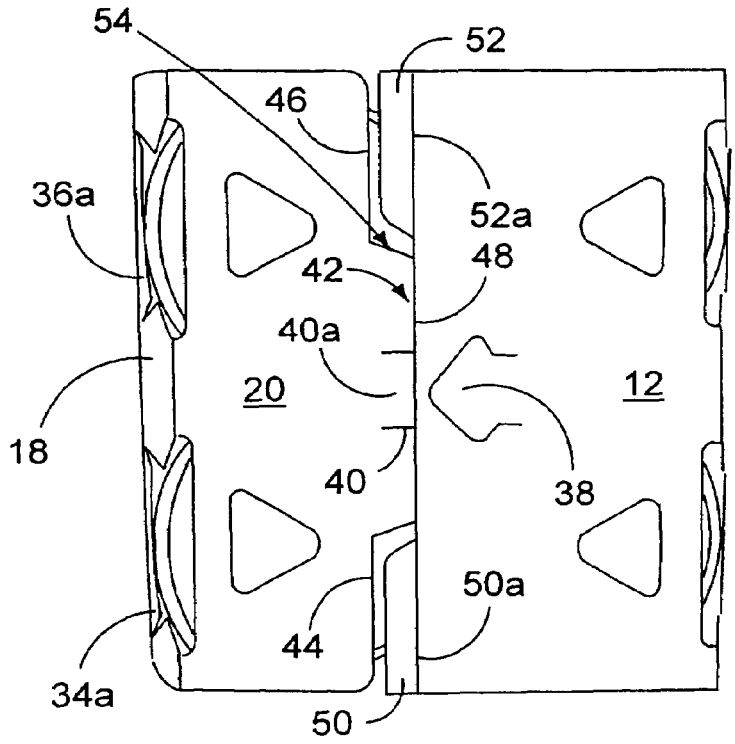
FIG. 3 is a plan view of the loaded carton showing the base panels being brought into an overlapping relationship.
Figure 4:
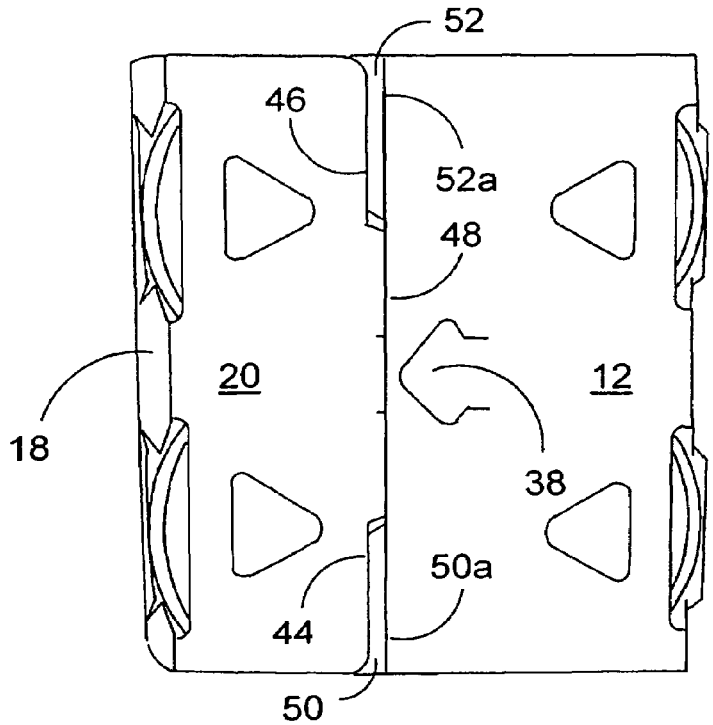
FIG. 4 is a plan view of the base panel similar to FIG. 3, but in which the locking tab is almost in registry with the locking aperture in order that the locking tab can be engaged.

Referring now to FIGS. 2 to 4 of the drawings, the blank is applied to the group of pots 'P' as shown so that the base panel 20 is brought into contact with the bases of the pots and the top wall 16 of the blank and the tops of the pots. Thus, peripheral heel portions of two adjacent pots are received in respective ones of the heel retention openings 34, 36.

The base panel 12 is then manipulated to overlie the other two remaining pots and during the course of manipulation the hinged flaps 50, 52 are folded inwardly of the carton along fold lines 50*a*, 52*a* respectively and are then introduced in sliding engagement beneath the end edge portions 44, 46 on either side of the projecting tongue 42 of end panel 20, shown in FIG. 3. Likewise, as the panels are brought into sliding overlapping relationship, the tongue 42 passes through recess 54 and beneath the end edge portion 48 of base panel 20 shown in FIG. 4.

Figure 5:
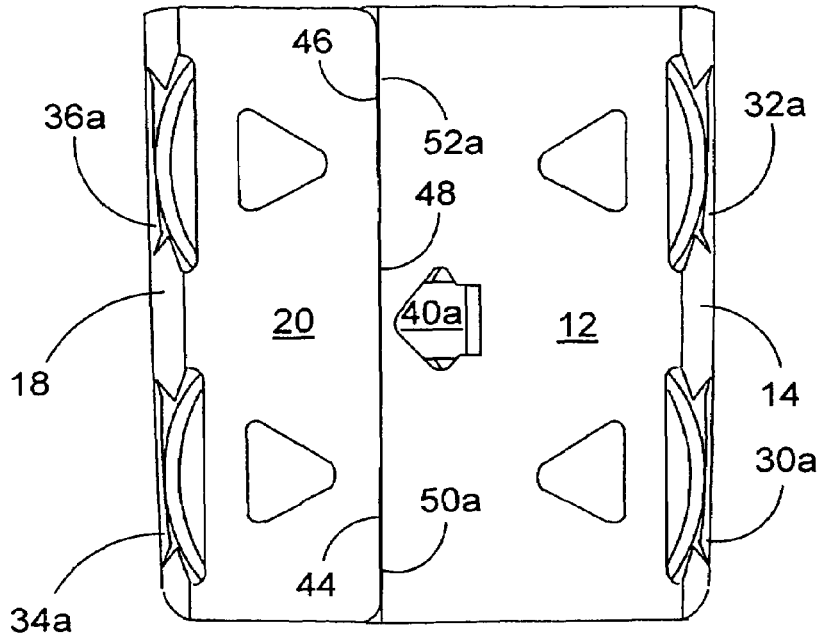
FIG. 5 is a plan view of the overlapped base panels of the completed carton in which the base panels are fully overlapped and locked together.

Thus, the panels are overlapped in an 'under and over' arrangement with the tongue 42 of base panel 20 underlying an intermediate area of base panel 12, while the adjacent end edges 44, 46 are overlying the hinged flaps 50, 52 shown in FIG. 5.

The overlapping engagement is best shown with reference to FIGS. 3 and 4. With reference to FIG. 5, when the base panels 12 and 20 are fully overlapped, it will be seen that the locking tab 38 is brought fully into overlying registry with the locking aperture 40 and thereafter it can be punch locked into locking engagement so as to secure the base panels 12, 20 together. When fully engaged in overlapping relationship, the end edge 48 of base panel 12 is in substantial alignment with the end edge portions 44, 46 of base panel 20.

Thus, when the base panels are fully overlapped in their 'over and under' arrangement and the securing lock engaged, there is only a relatively short run of exposed base panel, i.e. the recessed end edge 48 of base panel 12, which is vulnerable to being prized apart from base panel 20. However, the recessed end edge 48 is within the intermediate locked area of the base panels and is thus resistant to being lifted away from base panel 20.

Likewise, the 'over and under' locking arrangement prevents skewing, that is relative rotation of the base panels, around the central lock which was a disadvantageous feature of known conventionally overlapped base panels.

Figure 6:
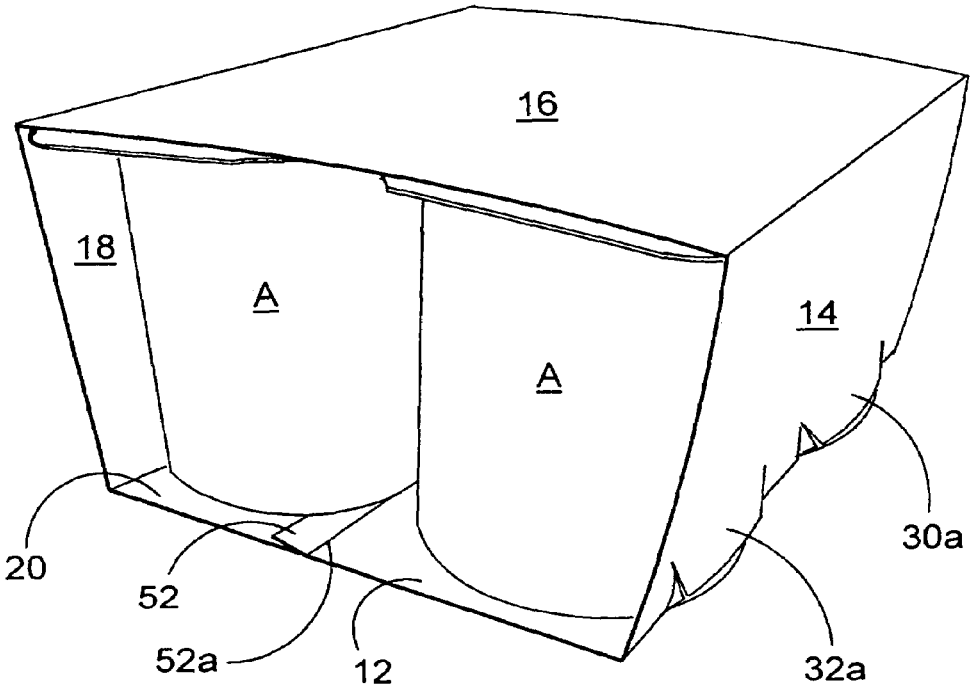
FIG. 6 is a perspective view of the loaded carton according to one embodiment of the invention as shown from above and one end.

The completed loaded carton is shown in perspective view in FIG. 6 of the drawings in which one of the hinged flaps is shown beneath the base of one of the pots. It will be recognized that as used herein, directional references such as 'top', 'base', 'end', 'side', 'upper', 'lower', 'inner' and 'outer' do not limit the respective panels to such orientation but merely serve to distinguish these panels from one another. Any reference to hinged connection should not be construed as necessarily referring to a single fold line only; indeed, it is envisaged that hinged connection can be formed from one or more of one of the following: a score line, a frangible line or a fold line, without departing from the scope of the invention.

It should be understood that numerous changes may be made within the scope of the invention. For example, the carton may be adapted to accommodate a single article or more than two articles. However, the size and shape of the apertures and panels may be adjusted according to the particular requirements of the articles to be packaged and other known article retention means may be employed. The present invention and its preferred embodiment relates to a carton which is shaped to provide satisfactory rigidity to hold items such as primary containers securely but with a degree of flexibility. The shape of the blank minimizes the amount of paperboard required for the carton. The items can be applied to the carrier by hand or automatic machinery. It is anticipated the invention can be applied to a variety of carton or tray types and not limited to those of the wrap-around sort.

What is claimed is:

1. A carton comprising first and second overlapping panels provided respectively with mutually engaged male and female punch-lock locking tabs and alignment means for facilitating alignment of the locking tabs during the panel interlocking process, the alignment means comprising a tongue protruding from an end edge of the first panel and a pair of flaps hinged in a spaced arrangement to an end edge of the second panel, wherein the second panel is disposed over the tongue while the hinged flaps are disposed under the first panel in engagement with the opposed side edges of the tongue and wherein each of the hinged flaps underlies the end edge of the first panel, one on each side of the protruding tongue.

2. A carton according to claim 1 wherein the protruding tongue includes a locking aperture which is engaged by the male locking tab disposed adjacent the end edge of the second panel to secure the overlapping first and second panels together.

3. A carton according to claim 2 wherein the locking aperture is defined by said female locking tab.

4. A wrap around style carton, comprising:

a tubular structure including a pair of side walls spaced apart by a top wall and a bottom wall, said bottom wall comprising:

first and second overlapping panels;

a tongue protruding from an end edge of the first panel; and a pair of flaps hinged in a spaced arrangement to an end edge of the second panel;

wherein said tongue and said hinged flaps extend internally of the tubular structure, said hinged flaps being in engagement with the opposed side edges of the tongue.

5. The carton of claim 4, wherein said tongue is secured to said second panel to interlock said first panel with said second panel.

6. The carton of claim 5, wherein said end edge of said first panel is substantially in abutment with said end edge of said second panel when said first panel is interlocked with said second panel.

7. The carton of claim 5, said first panel and said second panel being provided respectively with a mutually engaged male and female punch lock arrangement.

8. The carton of claim 7, wherein said mutually engaged male and female punch lock arrangement comprises at least one female locking aperture formed in said first panel, each said at least one female locking aperture being lockingly engaged by a male locking tab formed in said and said second panel.

9. The carton of claim 8, wherein said at least one female locking aperture is formed in said tongue.

* * * * *